United States Patent [19]

Ikeda et al.

[11] Patent Number: 4,578,331

[45] Date of Patent: Mar. 25, 1986

[54] COLOR IMAGE FORMING METHOD

[75] Inventors: Itsuo Ikeda, Sagamihara; Junji Kurokawa, Yokohama; Mitsuo Hasebe, Tokyo; Seiichi Miyagawa, Nagareyama; Hajime Hariu, Yokohama, all of Japan

[73] Assignee: Ricoh Company, Ltd., Japan

[21] Appl. No.: 629,354

[22] Filed: Jul. 10, 1984

[30] Foreign Application Priority Data

| | | | |
|---|---|---|---|
| Jul. 11, 1983 | [JP] | Japan | 58-124857 |
| Jul. 11, 1983 | [JP] | Japan | 58-124859 |
| Jul. 11, 1983 | [JP] | Japan | 58-124858 |
| Jul. 12, 1983 | [JP] | Japan | 58-125455 |

[51] Int. Cl.[4] ..... G03G 13/01

[52] U.S. Cl. ..... 430/42; 430/55; 346/157; 346/160; 355/4

[58] Field of Search ..... 430/42, 55; 346/157, 346/160; 355/4

[56] References Cited

U.S. PATENT DOCUMENTS

| | | | |
|---|---|---|---|
| 3,230,303 | 1/1966 | Macovski et al. | 346/157 X |
| 3,832,170 | 8/1974 | Nagamatsu et al. | 430/55 X |
| 3,884,686 | 5/1975 | Bean | 430/55 X |
| 4,275,134 | 6/1981 | Knechtel | 430/55 X |

FOREIGN PATENT DOCUMENTS

| | | | |
|---|---|---|---|
| 54-163025 | 12/1979 | Japan | 346/160 |
| 58-68756 | 4/1983 | Japan | 430/42 |

*Primary Examiner*—Roland E. Martin

*Attorney, Agent, or Firm*—Guy W. Shoup

[57] ABSTRACT

An electrophotographic color image forming process wherein three light beams each representing image information of one of three primary colors or yellow, magenta and cyan of a color document to be recorded obtained by color separation are projected against an electrophotographic photosensitive member to form electrostatic latent images which are developed by toners of the three different colors, respectively, and printed by transfer-printing, to record a color image. The image information of three colors is simultaneously written to a surface of the photosensitive member as three scanning lines either by successively writing a plurality of sets of three scanning lines each representing image information of one color or by writing image information of different colors of the same set separately in three different zones, so that the scanning lines representing image information of different colors form a repeating series of three stripes of different colors. The electrostatic latent images formed on the scanning lines are excited in positions immediately before developing sections of respective colors and developed by the toners of respective colors to produce toner images of different color which are printed by transfer-printing on a transfer-printing sheet.

8 Claims, 13 Drawing Figures

COLOR IMAGE FORMING METHOD

BACKGROUND OF THE INVENTION

This invention relates to a method of forming color images by an electrophotographic copying process wherein a photosensitve member is exposed to three light beams each containing image information of one of three primary colors or yellow, magenta and cyan obtained by color separating a colored document.

In one method known in the art of recording color picture images by using yellow, magenta and cyan image signals obtained by color separating a colored document in color by a peripheral color hard copy producing apparatus of a color facsimile system, computer, etc., a photosensitive member is scanned by three laser beams obtained by splitting a laser beam and modulating by color image information signals of the document and recording is performed by an electrophotographic process. In apparatus of the prior art used to carry this method into practice, a photosensitive member is exposed to optical images of three primary colors or yellow, magenta and cyan of the color document to form three electrostatic latent images either in three separate zones of the photosensitive member, by projecting the three color optical images simultaneously or by projecting one color optical image after another while the photosensitive member is rotated in timed relation to the projection of the color optical images. The three electrostatic latent images thus formed are developed by using toners of yellow, magenta and cyan to produce three toner images of different colors which are printed by transfer-printing on a transfer-printing sheet would on a transfer-printing drum in superposed relation in the same position by rotating the transfer-printing drum three times. Alternatively, a laser beam is split into three laser beam components which are each projected against one of three photosensitive drums to form an electrostatic latent image on the surface of each photosensitive drum, and the electrostatic latent images formed on the three separate photosensitive drums are developed by yellow, magenta and cyan toners, respectively, to form toner images of different colors which are printed by transfer-printing in the same position in superposed relation on a transfer-printing sheet which is fed to a transfer-printing station by being successively brought into contact with the three photosensitive drums, to thereby record a color image of the document.

As noted hereinabove, it has hitherto been usual practice in the prior art to print toner images of three different colors by transfer-printing in the same position of a transfer-printing sheet by superposing one toner image of one color after another. This process has suffered various disadvantages. One of them is that variations may be porduced in the positions of toner images of different colors on the transfer-printing sheet. Another disadvantage is that when the electrostatic latent images of different colors are formed in separte zones of the single photosenstiive drum, the photosensitive drum would have to have a large diameter. When three photosensitive drums are used each for forming one of the three electrostatic latent images of different colors, it would be necessary to use three sets of not only the photosensitive drum but also other equipment necessary for performing the electrophotographic copying process. The space required for installing the apparatus for performing the operation would be great and the equipment used would also become large in size. When the single photosensitive drum is rotated three times for recording a color image, the operation of performing recording would take a long period of time, although the space required to install the apparatus to perform the operation would not be large. To project three laser beam components obtained by splitting a laser beam against the photosensitive member in three separate zones in timed relation would require the provision of a plurality of mirrors each for one of the paths of the three laser beam components to separate the zones for projecting the laser beam components or the provision of a shift register to an output circuit of the each of solid state image sensors. This would render the apparatus complex in construction and require adjustment to be effected with a high degree of precision, resulting in a rise in cost.

As noted hereinabove, the electrophotographic color image recording system of the prior art has suffered the disadvantages that a large number of process steps have to be followed in effecting positioning of the images each time an electrostatic latent image of one primary color is developed into a color toner image and the toner images of different colors are superposed one over another to record a color image by transfer-printing, and that consequently the apparatus for carrying such method into practice becomes complex in construction and large in size. These disadvantages have been largely responsible for the fact that the system has not become popular against expectation.

SUMMARY OF THE INVENTION

This invention has been developed for the purpose of obviating the aforesaid disadvantages of the electrophotographic color image recording methods of the prior art. Accordingly, the invention has as its object the provision of an electrophotographic color image recording method which enables a color image of high quality free from variations in the positions of different colors to be obtained by performing transfer-printing of toner images of different colors in one operation without following three process steps one for a toner image of each color in performing transfer-printing of toner images of three colors, so that the recording speed can be raised as a result of a reduction in the number of process steps to be followed, the number of machines and equipment required and their sizes can be reduced, production cost can be reduced and reliability in performance can be increased.

To accomplish the aforesaid object, there is provided according to the invention an electrophotographic color image recording method wherein three light beams each representing image information of one of three primary colors or yellow, magenta and cyan of a document in color to be recorded are projected against an electrophotographic photosensitive member to expose same and form electrostatic latent images thereon, each of the electrostatic latent images is developed with a toner of one of the three different colors to form toner images of three different colors, and the toner images of the three different colors thus produced are printed by transfer-printing on a transfer-printing sheet to provide a color image of the document, characterized in that the electrophotographic photosensitive member is composed of at least a photoconductive material layer and a transparent insulating material layer disposed on a conductive substrate, and that the method comprises the steps of;

(a) uniformly charging a surface of the electrophotographic sensitive member from the transparent insulating material layer side by means of direct-current corona discharge;

(b) simultaneously projecting the three light beams each representing image information of one of the three colors onto the surface of the photosensitive member to expose same and successively write a multiplicity of sets of image information of three colors on the surface of the photosensitive member as a repeating series of three stripes of different colors simultaneously or immediately before the electrophotographic photosensitive member is subjected from the transparent insulating material layer side by a direct-current or alternationg-current corona discharge of a polarity opposite the polarity of the corona discharge performed in step (a);

(c) selectively irradiating portions of the surface of the electrophotographic photosensitive member exposed to the three light beams each representing image information of three colors to form electrostatic latent images corresponding to the image information of three different colors and developing each of the electrostatic latent images with a toner of one of the three colors to form toner images of three different colors, the aforesaid step being repeated for the image information of all the three different colors, and;

(d) printing by transfer-printing on a surface of a transfer-printing sheet the toner images of the three different colors obtained in step (c), to thereby record a color image of the document.

To accomplish the aforesaid object, there is also provided an electrophotographic color image recording method wherein three light beams each representing image information of one of three primary colors or yellow, magenta and cyan of a document in color to be recorded are projected against an electrophotographic photosensitive member to expose same and form three electrostatic latent images thereon, each of the three electrostatic latent images is developed by a toner of three different colors into toner images of three different colors, and the toner images of three different colors thus produced are printed by transfer-printing on a transfer-printing sheet to provide a color image of the document, characterized in that the electrophotographic photosensitive member is composed of a lower photo-sensitive material layer disposed on a conductive substrate and an upper photosensitive material layer disposed on the lower photosensitive material layer and having a certain degree of transparency, and that the method comprises the steps of;

(a) writing image information of the three different colors of the document in a multiplicity of sets to form electrostatic latent images on a surface of the electrophotographic photosensitive member in such a manner that the image information of each color is written in a position immediately before a developing section for the particular color as one scanning line, with the position for the image information of the same color for a second and following sets being spaced apart by two scanning lines from the position of the image information of a first set and the image inforamtion of different colors of each set being disposed such that the image information of a second color is disposed in a position adjacent the image information of a first color that has already been developed and the image information of a third color is disposed in a position adjacent the image information of a second color that has already been developed;

(b) scanning with a light beam of high intensity image information of one color that has already been developed which is adjacent image information of another color to be written that has already been developed when the image information of another color is written, to thereby erase a residual latent image or to reduce the potential thereof, and selectively developing only an electrostatic latent image of one color with a toner of the same color, the aforesaid step (b) being repeated for the image information of all the three colors to successively form toner images of the three different colors on the surface of the photosensitive member as a repeating series of three stripes of different colors, and (c) printing by transfer-printing on a surface of a transfer-printing sheet the toner images of the three different colors obtained in step (c), to thereby record a color image of the document.

DESCRIPTION OF THE PREFERRED EMBODIMENTS

Preferred embodiments of the color image forming method in conformity with the invention will now be described by referring to the apparatus shown in the accompanying drawings.

Figure 1:
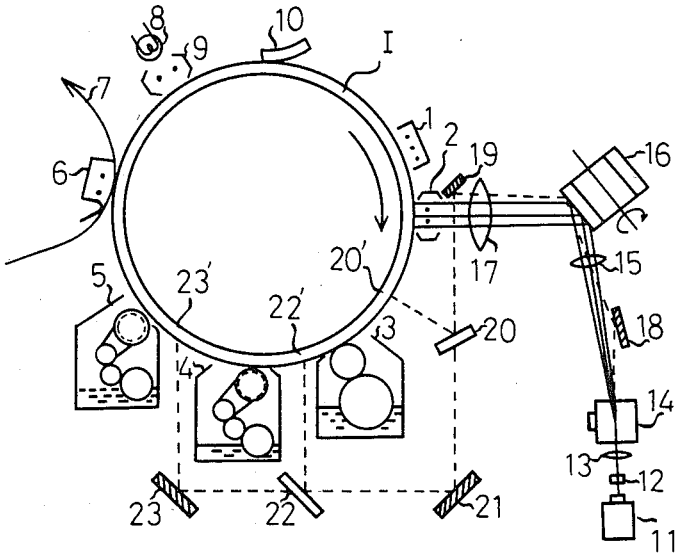
FIG. 1 is a sectional view of an apparatus suitable for carrying into practice a first embodiment of the color image forming method in conformity with the invention.

FIG. 1 shows as electrophotographic color image recording apparatus suitable for carrying into practice a first embodiment of the color image recording method in conformity with the invention. The color image recording apparatus comprises a photosensitive drum I, and a corona discharger 1 for positively charging a surface of the photosensitive drum I as primary charging, a corona discharger 2 for negatively charging the surface of the photosensitive drum I, a yellow developer 3, a magenta developer 4, a cyan developer 5, a transfer-printing corona discharger 6, a charge-removing device including a charge-removing lamp 8 and a corona discharger 9, and a cleaning member 10 are arranged around the photosensitive drum I in the indicated order in a direction of rotation of the drum I indicated by an arrow. The numeral 7 designates a transfer-printing sheet. A zone of the surface of the photosensitive drum I disposed in spaces juxtaposed relation to the negatively charging corona discharger 2 is where the surface of the photosensitive drum I is exposed to light beam representing image information of different colors to write same thereto.

To write the image information of different colors to the surface of the photosensitive drum I in the aforesaid zone, three light beams each representing image information of one of three primary colors or yellow, magenta and cyan of a document in color to be recorded are used. The three light beams are formed from image signals $S_Y$, $S_M$ and $S_C$ representing image information of yellow, magenta and cyan colors of color document as follows, which are produced by using color-separator, namely, blue, green and red filters, to split a light beam of the color document into three beam components, and sensing by three solid-state image sensors, and output therefrom.

When recording of a color image is performed by using signals produced by a color cathode ray tube, the image signals $S_Y$, $S_M$ and $S_C$ may be produced by mixing green and red signals, blue and red signals and blue and green signals, respectively.

Figure 2:
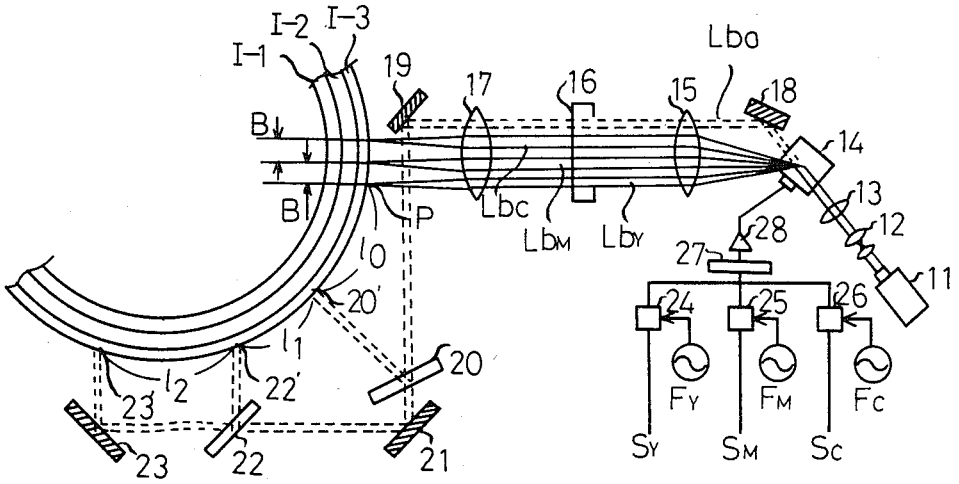
FIG. 2 is a fragmentary sectional view, on an enlarged scale, of the apparatus shown in FIG. 1.

Referring to FIG. 2, a laser beam produced by a light source 11 diverges by a beam expander 12 and converges by a first lens 13 before being incident on a simultaneous multifrequency drive type acousto-optic deflection device 14 where the laser beam is split into a zero-order diffracted beam $L_{bO}$ and first-order diffracted laser beams $L_{bY}$, $L_{bM}$ and $L_{bC}$ for writing image imformation of three colors which are to be developed by toners of yellow, magenta and cyan colors, respectively. The first-order diffracted laser beams $L_{bY}$, $L_{bM}$ and $L_{bC}$ thus produced are changed by a second lens 15 into parallel beams which are deflected as they are reflected by a rotating polygon mirror 16. After being corrected f-$\theta$ property by an f-$\theta$ lens 17, the first-order diffracted laser beams $L_{bY}$, $L_{bM}$ and $L_{bC}$ form images of a desired magnification on the surface of the photosensitive drum I and scanning same. The first-order diffracted laser beams $L_{bY}$, $L_{bM}$ and $L_{bC}$ are modulated by the image signals $S_Y$, $S_M$ and $S_C$ of different colors respectively as follows. The image signals $S_Y$, $S_M$ and $S_C$ produced by the respective solid-state image sensors are inputted to modulators 24, 25 and 26, respectively, shown in FIG. 2 to which high-frequency carriers $F_Y$, $F_M$ and $F_C$ of different frequencies are already inputted. After being modulated by the modulators 24, 25 and 26, the image signals $S_M$, $S_Y$ and $S_C$ are mixed at a mixer 27 into a single signal which is amplified by a power amplifier 28 before being inputted to the simultaneous multifrequency drive type acousto-optic deflection device 14. In the acousto-optic deflection device 14, the first-order diffracted laser beams $L_{bY}$, $L_{bM}$ and $L_{bC}$ are modulated by the image signals $S_Y$, $S_M$ and $S_C$, respectively, as aforesaid, and the modulated laser beams are projected at diffraction angles which vary depending on frequencies onto the surface of the photosensitive member I to scan same by spots formed by the beams thereon.

The photosensitive drum I is scanned simultaneously by the three spots of the three diffracted laser beams located close to each other, which are arranged in a direction perpendicular to a direction in which the beams $L_{bY}$, $L_{bM}$ and $L_{bC}$ scanning by the rotating polygon mirror 16 (the direction of the generating line of the photosensitive drum I), so that the image information of three different colors is written to the photosensitive drum I as a repeating series of three stripes. The yellow developer 3 is a reversal type developer using a usual magnetic brush, but the magenta and cyan developers 4 and 5 are each a contactless developer in which a clearance is provided between the toner and the surface of the photosensitive drum I on which the images are formed.

Figure 3:
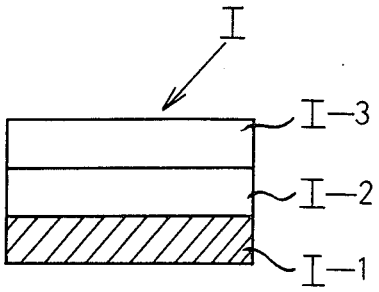
FIG. 3 is a schematic view of the photosensitive member of the apparatus shown in FIG. 1.

As shown on an enlarged scale in FIG. 2 and schematically in FIG. 3, the photosensitive drum I is of a triple construction comprising a transparent substrate I-1, a photoconductive material layer I-2 disposed on the substrate I-1 and a transparent insulating material layer I-3 disposed on the photoconductive material layer L-2.

The zero-order diffracted beam $L_{bO}$ produced by the simultaneous miltifrequency drive type acousto-optic deflection device 14 follows a path in which a mirror 18 is located as shown in FIG. 2. The beam $L_{bO}$ is reflected by the mirror 18 and incident on the second lens 15 which changes the beam $L_{bO}$ into a parallel beam which passes through the rotating polygon mirror 16 and f-$\theta$ lens 17. A mirror 19 is disposed in the path of the zero-order diffracted beam $L_{bO}$ released from the f-$\theta$ lens 17 to deflect the beam $L_{bO}$ incident thereon, so that the beam $L_{bO}$ is split by a half-mirror 20, a mirror 21, a half-mirror 22 and a mirror 23 into three beam components. The three beam components are projected onto the surface of the photosensitive drum I in positions 20', 22' and 23' immediately before upstream ends of the developers 3, 4 and 5 respectively. The mirrors 21 and 23 and half-mirrors 20 and 22 are located such that the spacing intervals $l_0$, $l_1$, and $l_2$ have the following relations $$l_0 = nB$$

$$l_1 = (n+1)B$$

$$l_2 = (n+2)B$$

where $l_0$ is the distance along the surface of the photosensitive drum I between a position P in which the photosensitive drum I is exposed to the first-order diffracted laser beam $L_{bY}$ to write the image information of the yellow color and the position 20', $l_1$ is the distance between the positions 20' and 22', $l_2$ is the distance between the positions 22' and 23', B is the distance between the positions in which the first-order diffracted laser beams $L_{bY}$, $L_{bM}$ and $L_{bC}$ form images, and n is an integer. Thus, when the optical images are written to the surface of the photosensitive drum I by the three first-order diffracted laser beams $L_{bY}$, $L_{bM}$ and $L_{bC}$, the zero-order diffracted beam $L_{bO}$ illuminates the positions 21', 22' and 23' on the surface of the photosensitive drum at the same time. Therefore, the positions in which the surface of the photosensitive drum I is exposed to the beams $L_{bY}$, $L_{bM}$ and $L_{bC}$ representing the image information of the three colors are selectively irradiated by the beams $L_{bO}$ in the positions 20', 22' and 23' respectively.

The color image recording method carried into practice by using the appratus of the aforesaid construction will now be described in detail.

(a) The surface of the photosensitive drum I is subjected to primary charging of positive polarity from the transparent insulating material layer I-3 side by the directcurrent corona discharger 1 to uniformly charge the surface of the photosensitive drum I;

(b) Secondary charging is carried out by the negative corona discharger (or alternating-current corona discharger) 2, and the surface of the photosensitive drum I is exposed to the first-order diffracted laser beams $L_{bY}$, $L_{bM}$ and $L_{bC}$ to write image information of the three colors disposed in a series of three stripes of different colors, simultaneously as or immediately before the secondary charging of the photosensitive drum I is effected;

(c - 1) As the position in which the surface of the photosensitive drum I is exposed to the first-order diffracted laser beam $L_{bY}$ shifts to the position 20', the image information of yellow color is irradiated selectively by the zero-order diffracted beam $L_{bO}$ reflected by the half-mirror 20 and an electrostatic latent image corresponding to the image information of the yellow color is excited, or called up, and developed by the yellow developer 3 with a yellow toner;

(c - 2) As the position in which the surface of the photosensitive drum I is exposed to the first-order diffracted laser beam $L_{bM}$ shifts to the position 22', an electrostatic latent image corresponding to the image information of magenta color is excited, and then developed by the magenta developer 4 with a magenta toner. At this time, the potential of the electrostatic latent image corresponding to the image information of yellow color is reduced as a result of being developed in the step (c - 1) to a level below the threshold value enabling development to be performed by the magenta developer 4, so that the electrostatic latent image corresponding to the image information of yellow color is not developed.

(c - 3) As the position in which the surface of the photosensitive drum I exposed to the first-order diffracted laser beam $L_{bC}$ shifts to the position 23', an electrostatic latent image corresponding to the image information of cyan color is excited and then developed by the cyan developer 5 with a cyan toner.

(d) Toner images of three different colors produced by the developing operations performed in the steps (c - 1), (c - 2) and (c - 3) are simultaneously printed on the transfer-printing sheet 7 by the transfer-printing corona discharger 6.

The toner images printed by transfer-printing on the transfer-printing sheet 7 are fixed by known means, thereby terminating the recording of a color image. Meanwhile, the surface of the photosensitive drum I has the charge removed by the charge removing device 8 and 9 is cleaned by the cleaner 10 to clear it of any toner that might be remaining thereon, so that the photosensitive drum I will be ready for the next color image recording operation.

Figure 4:
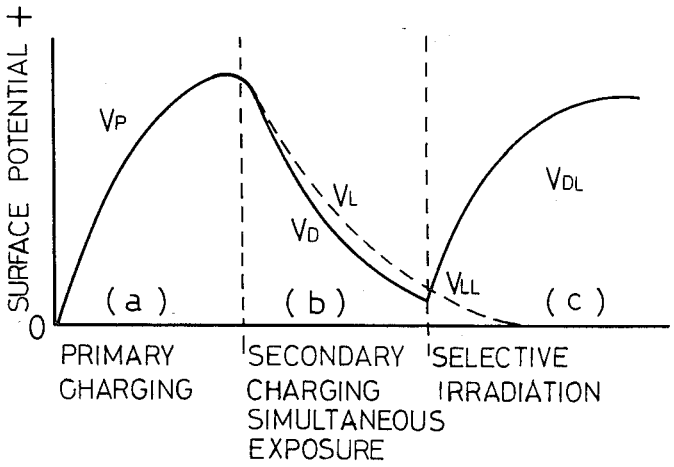
FIG. 4 is a diagrammatic representation of the process for forming an electrostatic latent image on the surface of the photosensitive member, showing the process steps of the method according to the invention.

FIG. 4 shows, in a diagrammatic view, changes in the surface potential of the photosensitive drum I occurring in the steps (a) to (c). In the diagram, $V_P$, $V_L$, $V_D$, $V_{LL}$ and $V_{DL}$ designate the surface potential of the photosensitive drum I at the time of the primary charging, the surface potential of the exposed section of the photosensitive drum I exposed to the first-order diffracted laser beams in the step (b), the surface potential of the surface of the photosensitive drum I not exposed to the first-order diffracted laser beams, the surface potential of a portion of the exposed section exposed to the first-order diffracted laser beams that is exposed the zero-order diffracted laser beam $L_{bO}$ in the step (c), and the surface potential of the exposed section of the photosensitive drum I exposed only to the zero-order diffracted laser beam $L_{bO}$, respectively. The surface potentials $V_{LL}$ and $V_{LD}$ are excited selectively immediately before the electrostatic latent images are developed with toners of different colors, to enable developing to be performed for each information of different color.

The zero-order diffracted laser beam for selectively irradiating the positions 20', 22' and 23' for the image information of different colors on the surface of the photosensitive drum I is produced by the same light source (laser oscillator) 11 as the first-order diffracted laser beams $L_{bY}$, $L_{bM}$ and $L_{bC}$ for writing the image information of different colors and split from the first-order diffracted laser beams at the simultaneous miltifrequency drive type acousto-optic deflection device 14. After passing through the same rotating polygon mirror 16 and f-$\theta$ lens 17, the zero-order laser beam $L_{bO}$ is led to the irradiation positions 20', 22' and 23'. Thus, by accurately setting the distances along the surface of the photosensitive drum I between the positions in which the image information of different colors is written and the positions 20', 22' and 23', respectively, in which irradiation is performed by the zero-order diffracted laser beam $L_{bO}$, it is possible to positively irradiate selectively the portions of the surface of the photosensitive drum I which have been exposed to the image information of different colors synchronously, thereby enabling control of operation to be readily effected.

In the apparatus shown in FIG. 1, the first one of the three developers 3, 4 and 5 is a reversal type developer which uses a magnetic brush, and the two other developers are each a contractless developer in which a clearance is provided between the surface on which an electrostatic latent surface is formed and the toner. This makes it possible to obviate the disadvantages of the toner image formed by the first developer by the following developers and contamination of toner images.

Figure 5:
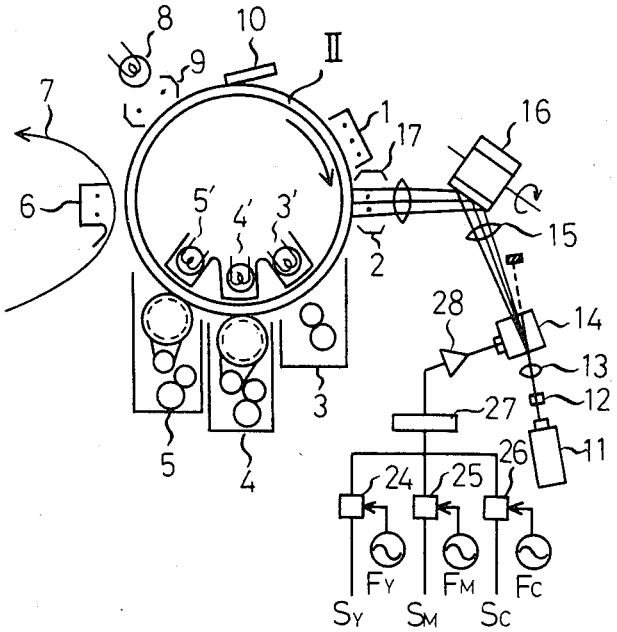
FIG. 5 is sectional view of an apparatus suitable for carrying into practice a second embodiment of the color image recording method in conformity with the invention.

FIG. 5 shows an apparatus suitable for carrying a second embodiment of the color image forming method in conformity with the invention into practice. The apparatus shown in FIG. 5 is substantially similar to the apparatus shown in FIG. 1 except that means of the former for selectively irradiating with light beams the portions of the surface of a photosensitive drum II which have been exposed to light beams representing image information of different colors in step (c) is distinct from that of the latter. In FIG. 5, members similar to those shown in FIG. 1 are designated by like reference characters.

Figure 6:
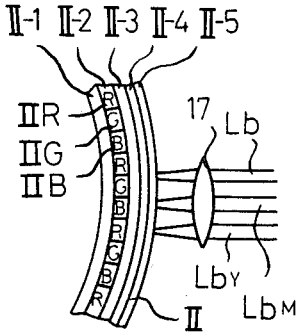
FIG. 6 is a fragmentary sectional view, on an enlarged scale, of the exposing section of the apparatus shown in FIG. 5.
Figure 7:
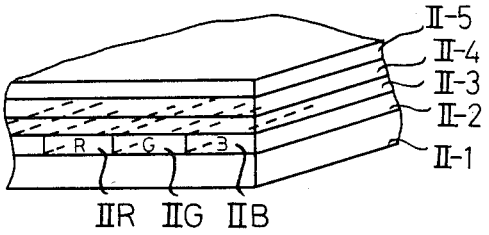
FIG. 7 is a schematic view of the photosensitive member of the apparatus shown in FIG. 5.

In the apparatus shown in FIG. 5, the means for selectively irradiating the portions of the surface of the photosensitive drum II which have been exposed to light beam representing image information of different colors comprises irradiating means which performs irradiation on the photosensitive drum II of the following construction. As shown in FIG. 7, the photosensitive drum II is composed of a transparent substrate II-1, a color filter layer II-2, a transparent conductive material layer II-3, a photoconductive material layer II-4 and a transparent insulating material layer II-5 arranged in superposed relation in the indicated order from inside the drum. The transparent substrate II-1 and color filter layer II-2 may be reversed in order. However, to enable clear electrostatic latent images to be produced, the color filter layer II-2 is preferably disposed adjacent the photoconductive material layer II-3, as shown. The color filter layer II-2 includes a blue filter member IIB, a green filter member IIG and a red filter member IIR arranged in a repeating series of three stripes of different colors oriented in the direction of the generating line of the photosensitive member II. The filter members IIB, IIG and IIR each have a width which corresponds to the spacing interval between the light spots on the surface of the photosensitive member II formed by the first-order diffracted laser bears $L_{bY}$, $L_{bM}$ and $L_{bC}$ to write image information of different colors, as shown in FIG. 6. Located in the interior of the photosensitive drum II are light sources 3', 4' and 5' having blue, green and red filters, which are capable of irradiating portions of the surface of the photosensitive drum II juxtaposed against the yellow developer 3, magenta developer 4 and cyan developer 5, respectively. In the apparatus shown in FIG. 5, the half mirrors 20 and 22 and mirrors 21 and 23 shown in FIG. 1 for splitting the zero-order diffracted laser beam $L_{bO}$ into a plurality of beam components in positions immediately before the respective developers for irradiating the positions 20', 22' and 23' on the surface of the photosensitive drum II are done without.

In the second embodiment of the color image recording method in conformity with the invention, image information of the three different colors of a color document to be recorded is simultaneously written to the surface of the photosensitive drum II in positions corresponding to the stripes of the filter members IIB, IIG and IIR in steps (a) and (b) as is the case with the first embodiment.

However, in step (c), selective irradiation of the portions of the surface of the photosensitive member II that have been exposed to the light beam representing the image information of different colors is performed as follows in a manner distinct from that of the first embodiment. Immediately before developing is performed, a blue light beam is emitted by the light source 3' having a blue filter from the transparent substrate II-1 side in a position corresponding to that of the yellow developer 3. The blue light is transmitted only through the stripes of the blue filter member IIB to selective irradiate the portions that have been exposed to the light beam representing the image information of yellow color while the adjacent portions that have been exposed to the light beam image representing the image information of magenta and cyan colors are not irradiated. Likewise, in a position corresponding to that of the magenta developer 4, a green light beam is emitted by the light source 4' having a green filter from the transparent substrate II-1 side to selectively irradiate the portions of the surface of the photosensitive drum II that have been exposed to the image information of magenta color corresponding to the stripes of the green member IIG. In a position corresponding to that of the cyan developer 5, a red light beam is emitted by the light source 5' having a red filter from the transparent substrate II-1 side to selectively irradiate the portions of the surface of the photosensitive drum II that have been exposed to the light beam representing the image information of cyan color corresponding to the stripes of the red filter member IIB.

Changes in the surface potential of the photosensitive drum II that is selectively irradiated with light beams are similar to those occurring in the first embodiment. The process steps followed after the aforesaid irradiation step are similar to those of the first embodiment.

To minimize the influences which might be exerted by the blue, green and red light beams projected from the transparent substrate II-1 side of the photosensitive drum II on portions of the surface of the photosensitive member II which are located adjacent the portions corresponding to the stripes of the blue, green and red filter members, each of the light beams used for irradiation preferably has a spectral band which in narrower than that of the stripes of the filter members. When the light sources for irradiation use color filters for selectively transmitting light beams of the desired colors as in this embodiment, the color filters for the light sources 3', 4' and 5' preferably have a narrower spectral band than the color filters IIB, IIG and IIR of the photosensitive member II.

Figure 8:
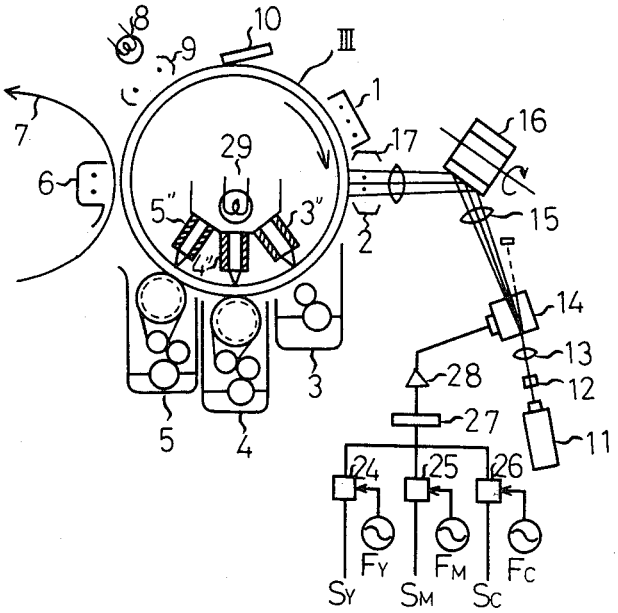
FIG. 8 is a sectional view of the apparatus suitable for carrying into practice a third embodiment of the color image recording method in conformity with the invention.
Figure 9:
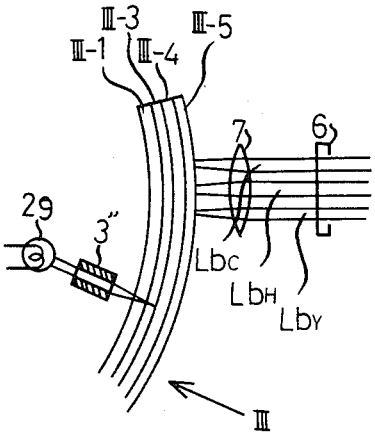
FIG. 9 is a fragmentary sectional view, on an enlarged scale, of a portion of the apparatus shown in FIG. 8.
Figure 10:
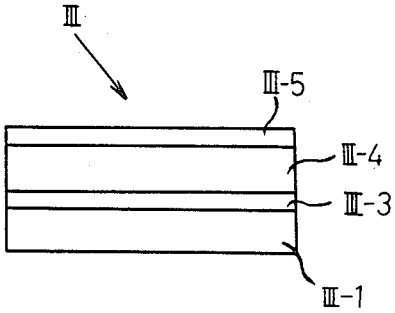
FIG. 10 is a schematic view of the photosensitive member of the apparatus shown in FIG. 8.

FIGS. 8–10 show an apparatus suitable for carrying the third embodiment of the color image forming method in conformity with the invention into practice. The apparatus shown in FIGS. 8–10 is substantially similar to the apparatus shown in FIGS. 1 and 5 expect that means of the former for selectively irradiating with light beams the portions of the surface of a photosensitive drum III which have been exposed to the light beam representing image information of different color in step (c) is distinct from that of the latter. Thus, in FIG. 8, members similar to those shown in FIGS. 1 and 5 are designated by like reference characters. As schematically shown in FIG. 10, the photosensitive drum III of the third embodiment is composed of a transparent substrate III-1, a transparent conductive material layer III-3, a photoconductive material layer III-4 and a transparent insulating material layer III-5 superposed one over another in the indicated order from inside the drum to provide a multilayer structure. The only differentce between the photosensitive drum III and the photosensitive drum II of the second embodiment is that the former lacks the color filter layer II-2 of the latter.

As shown in FIG. 8, a light source 29 is located in the interior of the photosensitive drum III, and focusing optical systems 3", 4" and 5" for focusing a light beam from the light source 29 into fine light lines on the back of the photo conductive material layer III-4 in positions corresponding to positions immediately before developing rollers of the yellow developer 3, magenta developer 4 and cyan developer 5 respectively. The focusing optical systems 3", 4" and 5" are arranged relative to each other such that when the position in which focusing of the light beam is effected by the focusing optical system 3" coincides with the portion of the surface of the photosensitive member III that has been written the image information of yellow color of a color document to be recorded, the positions in which the light beam is focused by the focusing optical systems 4" and 5" coincide with the portions of the surface of the photosensitive drum III that have been written the image information of magenta and cyan colors respectively.

The half mirrors20 and 22 and mirrors 21 and 23 for selectively reflecting and transmitting the zero-order diffracted laser beam $L_{bO}$ to allow light beams to be incident on the surface of the photosensitive member III in positions immediately before the yellow developer 3, magenta developer 4 and cyan developers 4 as shown in FIG. 1 are done without.

Selective irradiation of the portions of the surface of the photosensitive drum III that have been written the image inforamtion as a repeating series of three stripes of different colors is performed in steps (a) and (b) in the same manner as in the first embodiment, presently to be described.

The light source 29 is intermittently and momently actuated to emanate light when the portion of the surface of the photosensitive drum III that has been written the image information of yellow color moves to a position to be irradiated through the focusing optical system 3″ immediately before the yellow developer 3, so that irradiation of the photosensitive drum III is performed through the focusing optical system 3″ from the transparent substrate III-1 side in the form of thin line. Since the range in which irradiation is carried out is in the form of a thin line and momentary the portion of the surface of the photosensitive drum III written the image information of yellow color is selectively irradiated.

Simultaneously as the portion of the surface of the photosensitive drum III that has been written the image information of yellow color is selectively irradiated by a light beam from the light source 29 through the focusing optical system 3″, the portions of the surface of the photosensitive drum III that have been written the image information of magenta and cyan colors are selectively irradiated through the focusing optical systems 4″ and 5″ in positions immediately before the magenta developer 4 and cyan developer 5 respectively.

The surface potentials of the portions of the photosensitive drum III that have been selectively irradiated by light beams and the steps that are followed after the irradiation step are similar to those of the preceding embodiments.

In order that the portions of the surface of the photosensitive drum III exposed to the light beam representing the image information of the three primary colors, of the color document are selectively irradiated with light beams projected from inside the photosensitive drum III and the portions adjacent the exposed portions on the surface of the photosensitive drum III where latent images are formed are not irradiated, it is essential that irradiation and movement of the photosensitive drum III be exactly synchronized in such a manner that irradiation of the surface portion written the image information of one of the three color components is strictly timed to the passage of the exposed surface portion through the irradiation position of the particular color. The synchronization may be achieved by one of the following two processes.

(a) A halogen lamp of the usual type is used as the light source 29, and an array of shutters of high responsiveness, formed of an optical crystal, liquid crystal, etc., is arranged between the optical system 3″, 4″ and 5″ and opened and shut in synchronism with the moment of the exposed surface portions for the respective colors through the irradiation positions for the respective colors.

(b) A light emitting element of high responsiveness, such as an electroluminescence element, light emitting diode, laser diode, etc., is used as the light source 29 and actuated to emit light in synchronism with the movement of the exposed surface portions for the respective colors through the irradiation position for the respective colors. The light source may comprise three elements each for emitting light for one of the three colors or one element for emitting light which is split by means of slits into three beams for the respective three colors. For the focusing optical systems 3″, 4″ and 5″, of the light source 29, bar lenses array or a gradient-index rod lenses array may be used to achieve irradiation of the desired portion in the form of a fine line.

In the preceding embodiments, image information of three primary colors of the color document to be recorded has been described as being written to the surface of the photosensitive drum by using a simultaneous multifrequency drive type acousto-optic deflection device which enables signals of different colors to be simultaneously written. However, the invention is not limited to this specific form of device for writing color image information, and a device used in the prior art for writing signals of different colors successively in a repeating series of stripes line by line may be used. Also, the invention may have application in a system in which color images are written in the negative (image regions are irradiated with a laser beam but non-image regions are not irradiated) and reversal developing is performed or in a system in which color images are written in the positive and developing is performed by the usual technique of positive-to-positive developing.

A fourth embodiment of the color image recording method in conformity with the invention will be described by referring to an electrophotographic color image recording apparatus shown in FIG. 11, wherein the photosensitive drum IV is surrounded by a corona discharger 1 for performing primary charging of the surface of the photosensitive drum IV in the dark, a corona discharger 2 for performing secondary charging of the surface in the dark, a yellow color developing device 3, a magenta color developing device 4, a cyan color developing device 5, a corona discharger 6 for performing transfer-printing, a cleaning device 10 and charge removing devices 8 and 9 arranged in the indicated order in the direction of rotation of the photosensitive drum IV indicated by an arrow. The photosensitive drum IV is composed of a substrate IV-1, a photosensitive lower layer IV-2 formed as of Se—Te, and a photosensitive upper layer IV-3 formed as of an organic photoconductive material (OPC) and having a certain degree of transparency which are arranged in superposed relation in the indicated order as viewed from inside the drum IV.

Figure 12:
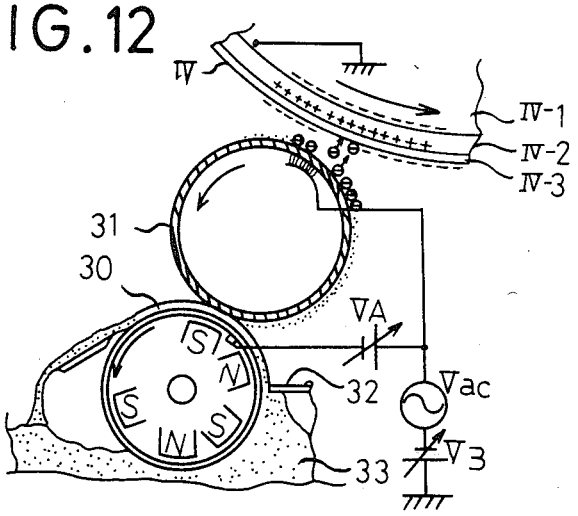
FIG. 12 is a sectional view of the developing section of the apparatus shown in FIG. 11.

The developing devices 3, 4 and 5 for the image information of the three primary colors of yellow, magenta and cyan, respectively, are of the dry contactless type in which each toner and the surface of the photosensitive drum IV on which each electrostatic latent image is formed are spaced apart from each other by a clearance and developing of the electrostatic latent image is achieved by causing each toner to transfer to the electrostatic latent image of the respective color. One example of the construction of the developing devices 3, 4 and 5 will be described by referring to FIG. 12. Each developig device comprises a sleeve roller 30 located in a lower portion of the device and having a surface layer formed of a photoconductive material, and a conductive donor roller 31 in contact with the sleeve roller 30 but spaced apart from the photosensitive drum IV by a suitable clearance. A developing agent 33 used is a developing agent of a binary system comprising a magnetic carrier and a non-magnetic toner. A layer of the developing agent 33 deposited on the surface of the sleeve roller 30 has its thickness regulated by a doctor blade 32 before being transferred to the surface of the donor roller 31 from which the toner is supplied to a portion of the photosensitive drum IV on which an electrostatic latent image is formed. As shown in FIG. 12, a bias impressing circuit is provided for producing direct-current bias voltages $V_A$ and $V_B$ and an alternating-current bias voltage $V_{ac}$. The bias voltages $V_A$ and $V_B$ are used for regulating the thickness of the toner layer formed on the donor roller 31 and the amount of the toner adhering to the latent image on the photosensitive drum IV respectively. The bias voltage $V_{ac}$ is used for stabilizing the transfer of the toner from the donor roller 31 to the photosensitive drum IV to avoid soiling of the background of a toner image printed on a transfer-printing sheet. The conductive donor roller 31 may be coated at its surface with a thin dielectric layer formed of resin or ceramics. Also, the surface of the donor roller 31 may be formed of a mixture of a conductive materials surface and a dielectric material surface.

The invention is not limited to the specific form of construction of the contactless developing devices described hereinabove and contactless developing devices of any known construction may be used.

Image information of the three primary colors or yellow, magenta and cyan of the color document to be recorded is written to the surface of the photosensitive drum IV in position immediately before the developing devices 3, 4 and 5 by using the first-order diffracted laser beams $L_{bY}$, $L_{bM}$ and $L_{bC}$, respectively, of a laser beam produced by the same process as described by referring to the preceding embodiments. Portions of the surface of the photosensitive drum IV in which image information of different colors is written by these beams are disposed in the same image forming zone in which scanning lines for image information writing are arranged in a subsidiary scanning direction as a repeating series of three stripes of different colors or Y, M, C, Y, M, C . . . in which stripes of the different colors are spaced apart from each other by one scanning line.

Thus, when the image information of yellow color is written, the surface of the photosensitive drum IV is scanned in a main scanning direction by the first-order diffracted laser beam $L_{bY}$ in every three scanning lines, to form electrostatic latent images in the positions in which the image information of yellow color is written. The electrostatic latent images thus formed are developed by the yellow developer 3.

Then, the first-order diffracted laser beam $L_{bM}$ is used to write the image information of magenta color by scanning lines each disposed in a position adjacent the positions in which toner images of yellow color are already formed. The time at which the yellow image information is written by one scanning line by the beam $L_{bY}$ and the time at which the magenta image information is written by the beam $L_{bM}$ by another scanning line adjacent the one scanning line for writing the yellow image information are different from each other by an amount corresponding to the time for rotation of photosensitive drum IV between the two scanning positions. Likewise, there is a lag between the time at which the image information of magenta color is written by the beam $L_{bM}$ by one scanning line and the time at which the image information of cyan color is written by another scanning line in a position adjacent the one scanning line for writing the image information of magenta color. Therefore, in order to bring the image information of three different colors written by scanning lines located adjacent one another into a series of stripes of different colors arranged in an orderly manner, the signals $S_Y$, $S_M$ and $S_C$ produced by color separation, are varied in time series by a shift register before they are inputted to the modulators 24, 25 and 26.

When an electrostatic latent image representing the image information of magenta color or cyan color is developed, the position of the scanning line adjacent the respective electrostatic latent image might be developed by a toner of magenta or cyan color and contamination of colors would occur if electrostatic latent image remained in the position of such scanning line. Thus, it would be necessary to erase an electrostatic latent image corresponding to the image information of yellow color in a scanning line adjacent a scanning line in which color image of magenta color is written simultaneously as the magenta color image writing. To this end, the apparatus shown in FIG. 11 uses a laser beam $L_{bE}$ of high intensity to scan the positions of the image information of yellow color adjacent the position of the image information of magenta color when the latter is written, and to scan the position of the image information of the magenta color adjacent the position of the image information of cyan color when the latter is written. The laser beam $L_{bE}$ for erasing the latent images may be the zero-order diffracted laser beam $L_{bO}$ obtained by the simultaneous multifrequency drive type acousto-optic deflection device 14 used for splitting the laser beam into the first-order diffracted laser beams $L_{bY}$, $L_{bM}$ and $L_{bC}$.

Figure 11:
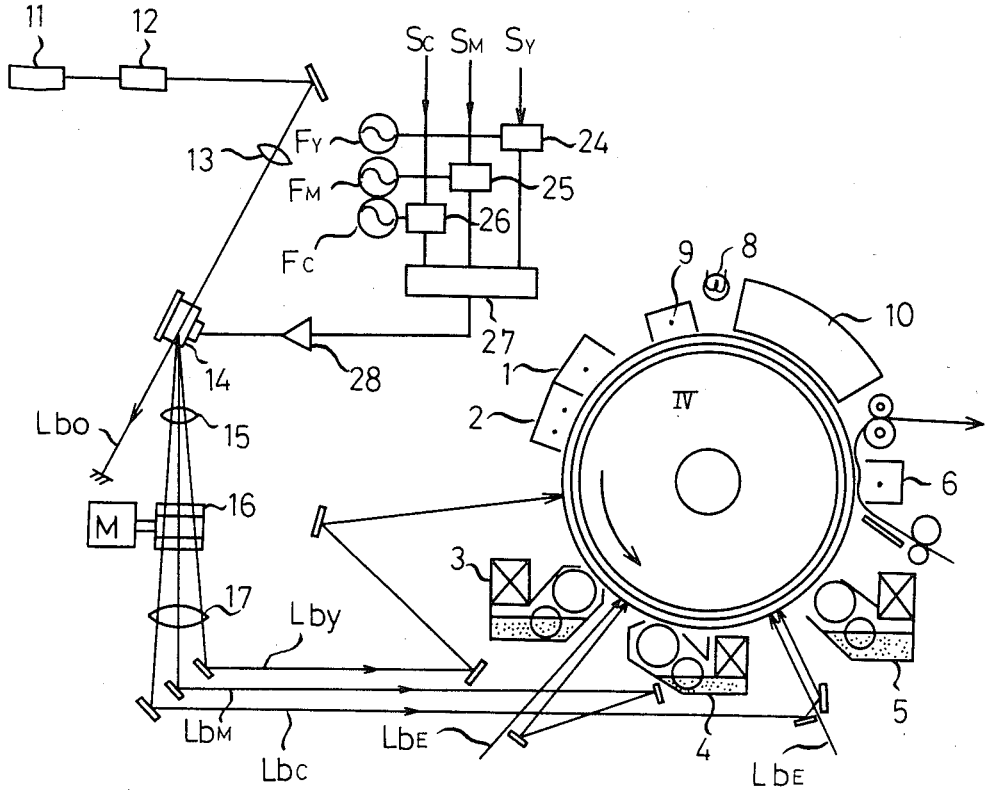
FIG. 11 is a sectional view of the apparatus suitable for carrying into practice a fourth embodiment of the color image forming method in conformity with the invention.
Figure 13:
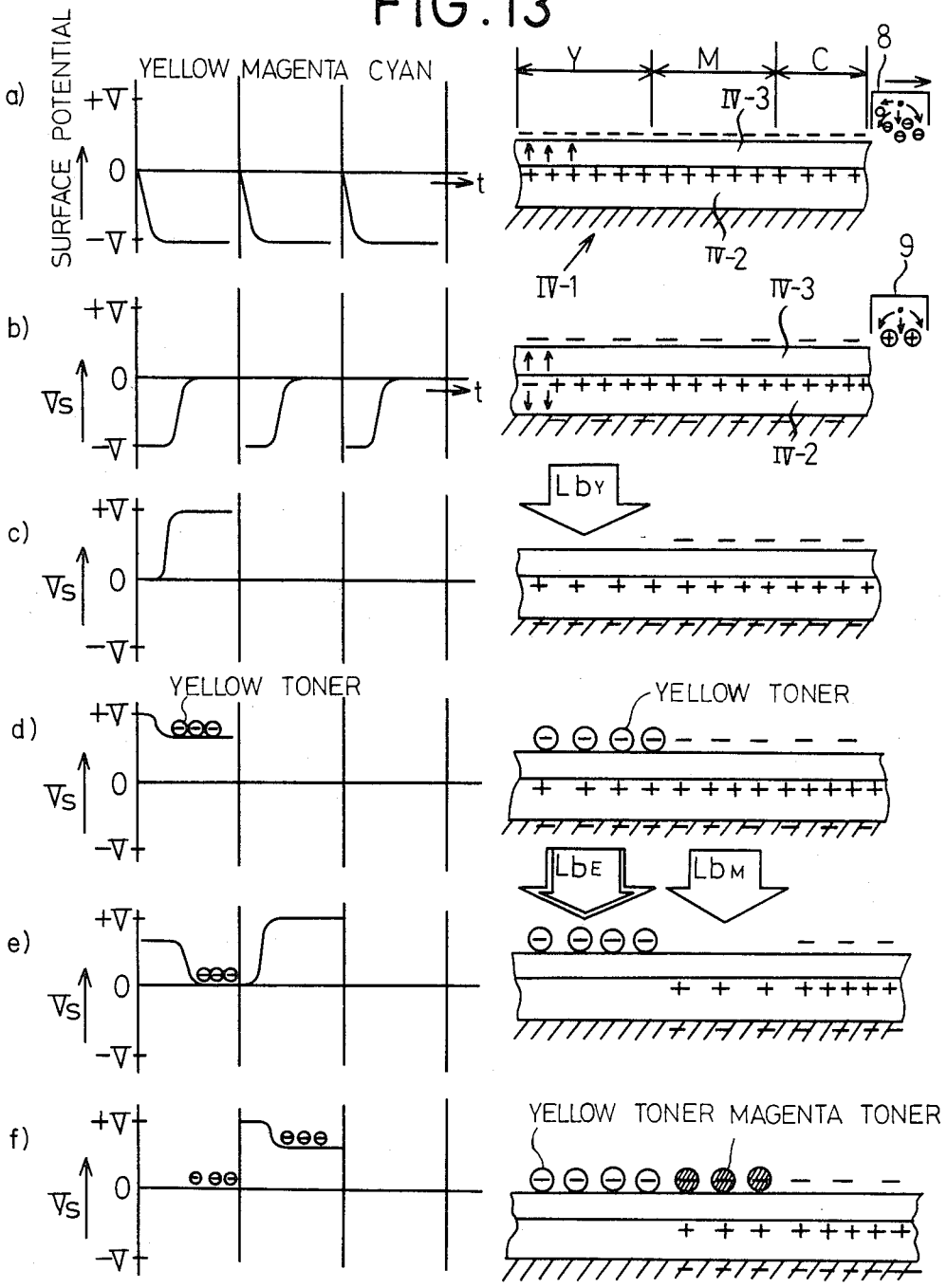
FIG. 13 is a schematic view in explanation of changes in the surface potential of the photosensitive member of the apparatus shown in FIG. 11 and the process for forming toner images of different color components of the color of the document to be recorded.

FIG. 13 shows a model of formation and erasion of electrostatic latent images and formation of toner images in various positions on the surface of the photosensitive drum IV corresponding to the image information of different colors produced when recording of a color image is performed by the apparatus of the construction shown in FIG. 11. FIG. 13 also shows changes in the surface potential of the developing sections of various colors for the photosensitive member that occurs in various steps of the method.

(a) Step of Primary Negative Charging in the Dark

The primary negative charging of this step is performed by means of the corona discharger 1. Since the OPC of the upper-layer IV-3 of the photosensitive drum IV has a negative carrier characteristic, it is negatively charged. Since the Se—Te of the lower-layer IV-2 has a positive characteristic, it is not charged.

(b) Step of Secondary Charging in the Dark

This step is performed by means of the corona discharger 2. In this step, the potential is split equally between the upper-layer IV-3 and lower-layer IV-2 (the surface potential is zero).

(c) Yellow Image Information Writing Step

To form at electrostatic latent image corresponding to image information of the yellow color of the color document, a portion of the surface of the photosensitive drum IV corresponding to the image information of yellow color is scanned by the laser beam $L_{bY}$ of usual intensity representing the image information of yellow color. The laser beam $L_{bY}$ is intended to excite only the OPC of the upper-layer IV-3 and the potential of the lower-layer IV-2 is not removed, so that the positive potential forms a latent image. The potential in other portions of the photosensitive drum IV is zero.

(d) Yellow Image Information Developing Step

A toner of yellow color which is negatively charged adheres only to the electrostatic latent image formed in the position corresponding to the image information of yellow color, to develop the latent image into a yellow toner image.

(e) Magenta Image Information Writing Step

Simultaneously as the image information of yellow color is writtem in step (d), a portion of the surface of the photosensitive drum IV corresponding to the image information of magenta color is scanned by the laser beam $L_{bM}$ of usual intensity representing the image information of magenta color to thereby form an electrostatic latent image of positive potential in this position. The position of the image information of yellow color is scanned by the laser beam $L_{bE}$ of high intensity, to erase the potential of the latent image.

(f) Magenta Image Information Developing Step

A toner of magenta color adheres only to the latent image formed in the position corresponding to the image information of magenta color to thereby develop the latent image into a magenta toner image.

With regard to the image information of cyan color, writing is carried our by a laser beam $L_{bC}$ representing the image information of cyan color to form an electrostatic latent image which is subsequently developed by a cyan toner while the latent image representing the magenta image information is erased by the laser beam $L_{bE}$ of high intensity.

If necessary, the color document may be split into four colors by using filters of green, blue, red and yellow, and electrostatic latent images formed by laser beams representing image information of four colors may be developed with yellow, magenta, cyan and black toner respectively. This is conducive to improved quality of the color image produced.

A composite toner image obtained from toner images of different colors formed in a repeating series of three stripes of different colors in the same zone on the surface of the photosensitive drum is printed by transfer-printing on the transfer-printing sheet 7 by the corona discharger 6 for transfer-printing. When the color image printed on the transfer-printing sheet is fixed by the usual process, the operation of recording a color image of the document is finished.

By incorporating a suitable amount of wax or other readily soluble material in the color toners and enlarging the dot pattern of the toner by thermal dissolution after being fixed, it would be possible to increase the vividness of colors in the recorded color image, although resolution might be sacrificed to some degree.

In the present invention, contactless developers are used for developing electrostatic latent images representing image information of different colors by using nonmagnetic toners. This eliminates the trouble that a toner image of one color might be brought into contact with a toner image of another color already formed on the photosensitive drum, thereby disturbing the color image obtained as an end product or resulting in contamination of the color in the recorded color image.

What is claimed is:

1. An electrophotographic color image forming process wherein three light beams each representing image information of one of three primary colors or yellow, magenta and cyan of a document in color to be recorded are projected against an electrophotographic photosensitive member to expose same and form electrostatic latent images thereon, each of the electrostatic latent images is developed with a toner of one of the three different colors to form toner images of three different colors, and the toner images of the three different colors thus produced are printed by transfer-printing on a transfer-printing sheet to provide a color image of the document, characterized in that the electrophotographic photosensitive member is composed of at least a conductive substrate, a photoconductive material layer disposed on said substrate and a transparent electrically insulating layer disposed on said photoconductive material layer, and that the process comprises the steps of:

(a) uniformly charging a surface of the photoelectrographic photosensitive member from the transparent insulating material layer side by means of direct-current corona discharge of one polarity;

(b) projecting the three light beams each representing image information of one of the three colors against the surface of the photosensitive member to expose same and successively write a multiplicity of image information of three colors on the surface of the photosensitive member as a repeating series of three stripes of different colors simultaneously as or immediately before the electrophotographic photosensitive member is subjected from the transparent insulating material layer side by a direct-current or alternating-current corona discharge of a polarity opposite the one polarity of the corona discharge performed in step (a);

(c) selectively irradiating portions of the surface of the electrophotographic photosensitive member exposed to one of the three light beams to form electrostatic latent images corresponding to the image information of the one of the three colors and reverse developing the electrostatic latent image with a toner of the color to form toner images of the color, the aforesaid step being repeated for the image inforamtion of all the three different colors; and (d) printing by transfer-printing on a surface of a transfer-printing sheet the toner images of the three different colors obtianed in step (c).

2. An electrophotographic color image forming process as claimed in claim 1, wherein said three light beams used for writing the image information of three color in step (b) comprise three first-order diffracted laser beams produced from a single laser beam at different diffracted angles by introducing said laser beam into a simultaneous multifrequency drive type acousto-optic deflection device and modulating the three first-order diffracted laser beams by image signals representing the image information of three colors which are modulated by carriers of different frequencies.

3. An electrophotographic color image forming process as claimed in claim 1, wherein the electrostatic latent images representing image information of second and third colors are reversely developed in step (c) by a contactless developing system wherein a surface of the photosensitive member on which the electrostatic latent images are formed and the surface of toner layer are spaced apart from each other by a clearance.

4. An electrophotographic color image forming process as claimed in any one of claims 1–3, wherein the light beam used in step (c) to irradiate the portion of the electrophotographic photosensitive member exposed to each one of the three light beams to form the electrostatic latent image corresponding to the image information of each one of three colors comprises zero-order diffracted laser beam produced from a single laser beam by the simultaneous multifrequency drive type acousto-optic deflection device, said zero-order diffracted laser beam being used to irradiate the photosensitive member from the transparent insulating material layer side after being handled by the same deflection device and f-$\theta$ characteristic correcting means that handle the first-order diffracted laser beams.

5. An electrophotographic color image forming process as claimed in any of claims 1–3, wherein the electrophotographic photosensitive member is composed of a transparent substrate enabling the portions of the photosensitive member exposed to color image information by the three light beams in step (c) to be selectively irradiated, a color filter layer including filters for yellow, magenta and located in positions exposed to the light beams representing image information of three colors, a transparent conductive layer, a photoconductive material layer disposed on said transparent conductive layer and a transparent electrically insulating layer disposed on said photoconductive material layer and the light beam used in step (c) for selectively irradiating the portions of the electrophotographic photosensitive member exposed to each one of the three light beams is projected from the transparent substrate side and has three colors substantially the same as the color of the filter arranged as a repeating series of stripes in the color filter layer of the photosensitive member.

6. An electrophotographic color image forming process as claimed in any one of claims 1–3, wherein said electrophotographic photosensitive member is composed of a transparent substrate enabling the portions of the photosensitive member exposed to color image information by the three light beams in step (c) to be selectively irradiated, a transparent conductive layer, a photoconductive material layer disposed on said transparent conductive layer and a transparent electrically insulating layer disposed on said photoconductive material layer and the light beam used in step (c) for selectively irradiating the portions of the electrophotographic photosensitive member exposed to each one of the three light beams is in the form of a thin beam of light intermittently emitted and directed through three focusing optical systems against the respective positions corresponding to the image information of three colors.

7. An electrophotographic color image forming process wherein three light beams each representing image information of one of three primary colors or yellow, magenta and cyan of a document in color to be recorded are projected against an electrophotographic photosensitive member to expose same and form electrostatic latent images thereon, each of the electrostatic latent images is developed with a toner of one of the three different colors to form toner images of three different colors, and the toner images of the three different colors thus produced are printed by transfer-printing on a transfer-printing sheet to provide a color image of the document, characterized in that the electrophotographic photosensitive member is composed of at least a photoconductive material layer and a transparent photoconductive material layer disposed on a conductive substrate, and that the method comprises the steps of:

(a) primary negative charging in the dark performed by means of a corona discharger;

(b) secondary charging in the dark performed by means of a corona discharger;

(c) writing image information of the three different colors of the document in a multiplicity of sets to form electrostatic latent images on a surface of the electrophotographic photosensitive member in such a manner that the image information of each color is written in a position immediately before a developing section for the particular color as one scanning line, with the position for the image information of the same color for a second and following sets being spaced apart by two scanning lines from the position of the image information of a first set and the image information of different colors of each set being disposed such that the image information of a second color is disposed in a position adjacent the image information of a first color that has already been developed and the image information of a third color is disposed in a position adjacent the image information of a second color that has already been developed;

(d) scanning with a light beam of high intensity image information of one color that has already been developed which is adjacent image information of another color to be written when the image information of the another color is written, to thereby erase a residual latent image or to reduce the potential thereof, and selectively developing only an electrostatic latent image of the another color with a toner of the same color, the aforesaid step (d) being repreated for the image information of all the three colors to successively form toner images of the three different colors on the surface of the photosensitive member as a repeating series of three stripes of different colors; and (e) printing by transfer-printing on a surface of a transfer-printing sheet the toner images of the three different colors obtained in step (d), to thereby record a color image of the document.

8. An electrophotographic color image recording method as claimed in claim 7, wherein the electrostatic latent images representing image information of the three primary colors of the document are developed by saying non-magnetic toners, and wherein the electrostatic latent images of at least the second and third colors are developed by a contactless developing system.

* * * * *